United States Patent [19]

Stapf

[11] Patent Number: 4,804,224

[45] Date of Patent: Feb. 14, 1989

[54] RECLINING BENCH

[76] Inventor: Wayne C. Stapf, 159 W. Sumner Ave., Martinsville, Ind. 46151

[21] Appl. No.: 212,015

[22] Filed: Jun. 27, 1988

[51] Int. Cl.[4] ..... A47C 1/00

[52] U.S. Cl. ..... 297/355; 297/232

[58] Field of Search ..... 297/355, 68, 85, 356, 297/377, 232

[56] References Cited

U.S. PATENT DOCUMENTS

| | | | |
|---|---|---|---|
| 1,251,709 | 1/1918 | Turner | 297/355 |
| 1,260,358 | 3/1918 | Lotz | 297/281 |
| 1,612,036 | 12/1926 | Lovik | 297/354 |
| 2,714,418 | 8/1955 | Malco | 297/118 |
| 3,316,013 | 4/1967 | Abel et al. | 297/232 |
| 3,544,160 | 12/1970 | Karasick | 297/355 |
| 3,653,713 | 4/1972 | Reason et al. | 297/232 |
| 4,632,452 | 12/1986 | Vogel | 297/232 |
| 4,707,023 | 11/1987 | Hickey | 297/31 |

*Primary Examiner*—James T. McCall

*Attorney, Agent, or Firm*—Henderson & Sturm

[57] ABSTRACT

A reclining bench having a pair of elongated platform members and a pair of pivotally attached upright members having a seat and back attached thereto. A pair of cams disposed between the seat and the platforms make the reclining bench adjustable from and between a reclined position wherein it is tipped back against a stop member attached to the platform members to a forward position resting upon a flat top of the cam members.

1 Claim, 2 Drawing Sheets

RECLINING BENCH

TECHNICAL FIELD

The present invention relates generally to an improved bench, and more particularly to a two-position reclining bench.

BACKGROUND ART

Prior art benches are typically not reclining but even those benches which have a reclining feature tend to be overly complicated and somewhat expensive to construct.

Consequently, there is a need for an improved bench structure which is economical to produce, dependable in its use and simple to adjust.

DISCLOSURE OF THE INVENTION

The present invention relates to a reclining bench having a pair of elongated platform members and a pair of pivotally attached upright members having a seat and back attached thereto. A pair of cams disposed between the seat and the platforms make the reclining bench adjustable from and between a reclined position wherein it is tipped back against a stop member attached to the platform members to a forward position resting upon a flat top of the cam members.

An object of the present invention is to provide an improved reclining bench.

Another object of the present invention is to provide a reclining bench with a simple cam structure.

Another object of the present invention is to provide a reclining bench which is economical to produce, and dependable and simple to use.

A still further object of the present invention is to provide a reclining bench of the aforementioned type which can easily be assembled for use or disassembled for transporting from place to place.

Other objects, advantages, and novel features of the present invention will become apparent from the following detailed description of the invention when considered in conjunction with the accompanying drawings.

BEST MODE FOR CARRYING OUT THE INVENTION

Figure 1:
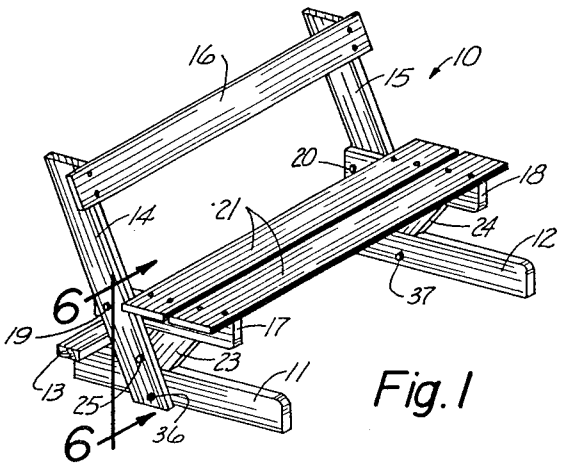
FIG. 1 is a perspective view of a preferred embodiment of the present invention shown in an upright, position.

Referring now to the drawings wherein like reference numerals designate identical or corresponding parts throughout the several views, FIG. 1 shows a reclining bench (10) constructed in accordance with the present invention.

The reclining bench (10) shown in FIG. 1 includes a first and second elongated platform member (11) and (12) which are adapted to contact a floor or to be placed on the ground. The first and second elongated platform members (11) and (12) have a stop member (13) rigidly attached to the top rear thereof, such as by nails or bolts (not shown).

First and second elongated upright members (14) and (15) are pivotally attached at the bottom thereof by nut and bolt structures (36) and (37) for pivotally attaching the first and second upright members to the first and second elongated platform members (11) and (12) respectively. A back support (16) is attached at each end by nails or bolts to the top of the first and second elongated upright members (14) and (15) and a pair of cantelever members (17) and (18), are attached to an intermediate portion of the first and second elongated upright members (14) and (15) such as by nut and bolt structures (19) and (20). This allows the seat members (21), which are nailed or bolted to the top of the cantelever members (17) and (18) to be pivotally attached with respect to the first and second elongated upright members (14) and (15).

A pair of cam members (23) and (24) are pivotally attached by nut and bolt members (25) and (26) to the first and second elongated upright members (14) and (15) respectively for movement between the positions shown in FIGS. 1–5 and the position shown in FIGS. 7–11.

Figure 4:
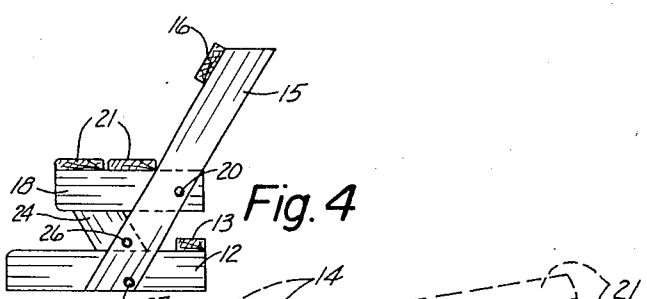
FIG. 4 is a view of the other side of the bench in the upright position as compared to the FIG. 2 side.
Figure 6:
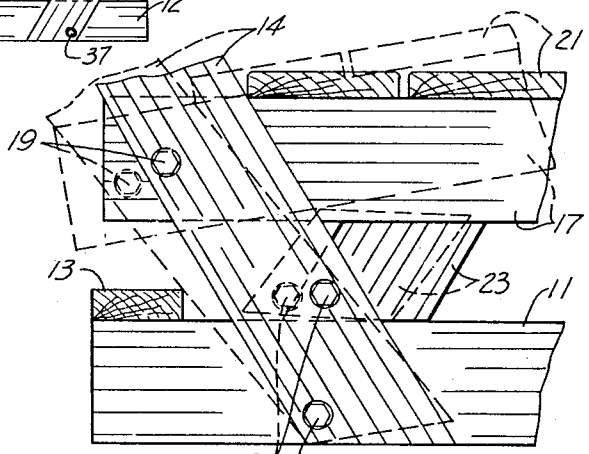
FIG. 6 is an enlarged partial side elevational view of the cam mechanism and reclining feature of the present invention showing such structure in solid lines in the FIG. 1 position and in dashed lines to show the position of the structural members in a reclined position.
Figure 3:
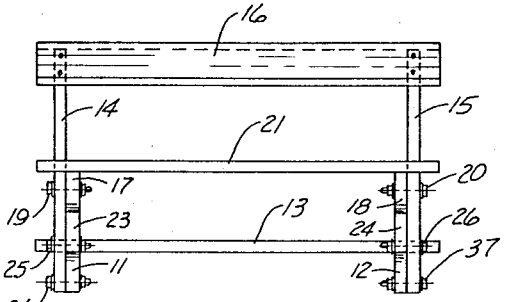
FIG. 3 is a front elevational view of the apparatus of FIG. 1.

Looking to FIG. 6, it is noted that the cantelever member (17) is on top of the flat surface of the cam (23) and the bottom of the cam (23) is flat against the top of the first elongated platform member (11) so as to support the reclining bench in the upright position shown in FIGS. 1–5. It will be understood, of course, that the cam member (24) and the related structure on the other side of the reclining bench (10) operate precisely the same and simultaneously with the structure shown in FIG. 6.

Figure 2:
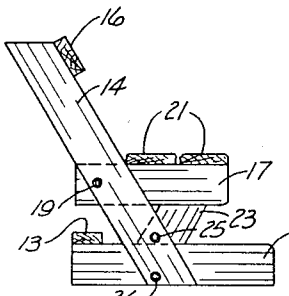
FIG. 2 is a side elevational view of the apparatus as shown in the position shown in FIG. 1.
Figure 5:
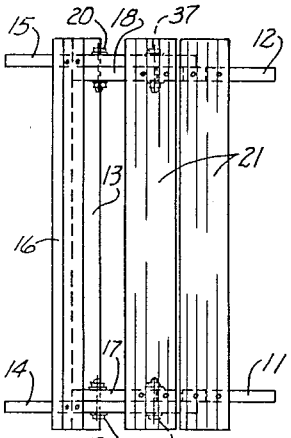
FIG. 5 is a top plan view of the reclining bench of FIG. 1.
Figure 10:
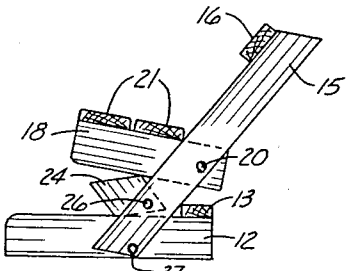
FIG. 10 is a side elevational view of the opposite side of the reclining bench from that shown in FIG. 8.
Figure 9:
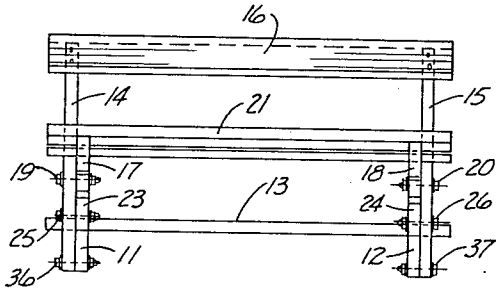
FIG. 9 is a front elevational view of the reclining bench shown in FIG. 7.
Figure 7:
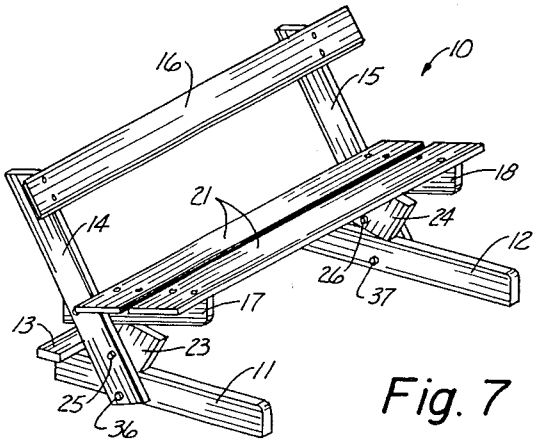
FIG. 7 is a perspective view of the present invention when moved to a reclined position.
Figure 8:
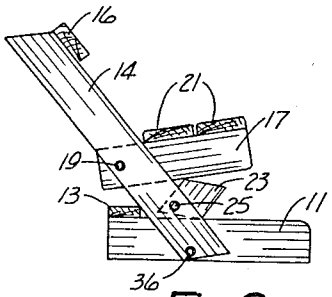
FIG. 8 is a view of one side of the reclining bench show in FIG. 7 in a reclined position.
Figure 11:
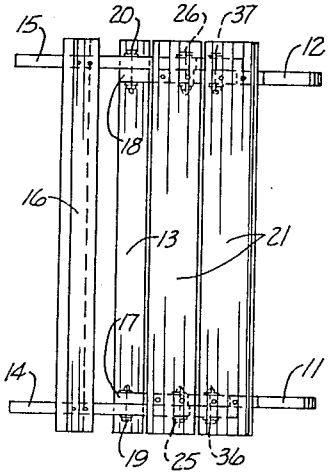
FIG. 11 is a top plan view of the reclining bench in the position shown in FIG. 7.

When it is desired to move the reclining bench (10) from the position shown in FIG. 1 to the position shown in FIG. 2, a person seated on the bench (10) would push down with his or her legs against the floor and then push back, thereby causing the seat (21), back support (16) and the associated structural members including cantelever members (17) and (18) and first and second elongated upright members (14) and (15) to move back to the dashed position shown in FIG. 6 into the position shown in solid lines in FIGS. 7, 8 and 10. During this reclining process, the cam members (23) and (24) move rearwardly toward the stop (13) and the first and second elongated upright members (14) and (15) abut the stop member (13). In such reclining position, the top rear of the cam members (23) and (24) abut the bottom of the cantelever members (17) and (18) and the front bottom of the cam members (23) and (24) abut the top of the first and second elongated platform members (11) and (12).

Of course to reverse this procedure, the user merely pulls the bench forward to the position shown in FIG. 1, and it will remain in that position until moved rearwardly again by the user.

Accordingly, it will be appreciated that the preferred embodiment disclosed herein does indeed accomplish the aforementioned objects. Obviously, many modifications and variations of the present invention are possible in light of the above teachings. It is therefore to be understood that, within the scope of the appended claims, the invention may be practiced otherwise than as specifically described.

I claim:

1. A reclining bench comprising:

a first elongated platform member having a top, a bottom, two sides, a front end and a rear end;

a second elongated platform member having a top, a bottom, two sides, a front end and a rear end;

a stop brace extending from the top rear end of said first elongated platform member to the top rear end of said second elongated platform member and being rigidly connected to said first and second elongated platform members;

a first elongated upright member pivotally attached at the bottom thereof to an intermediate portion of said first elongated platform member along a first horizontal axis, said first elongated upright member being pivotal between a first position in abutment with said stop brace and a second position forward of said stop brace;

a second elongated upright member pivotally attached at the bottom thereof to an intermediate portion of said second elongated platform member along said first horizontal axis, said second elongated upright member being pivotal between a first position in abutment with said stop brace and a second position forward of said stop brace;

a back support attached at one end to a top portion cf said first elongated upright member and attached at the other end to a top portion of said second elongated upright member;

seat means attached to an intermediate portion of said first and second elongated upright members for permitting people to sit thereon and lean back into abutment with the back support, said seat means including a first elongated cantelever member rigidly attached at one end thereof to said first elongated upright member and being disposed directly above said first elongated platform member and a second elongated cantelever member rigidly attached at one end thereof to said second elongated upright member and being disposed directly above said second elongated platform member;

a first cam member having a flat top edge and a flat bottom edge, said first cam member being pivotally attached to portion of said first elongated upright member between at a second horizontal axis disposed between said stop brace and the top of said first elongated platform member, said first cam member being movable between a first position wherein a rear top corner of said first cam member is in contact with the bottom of said first elongated cantelever member and the front bottom of said first cam member is in contact with the top of said first elongated platform member when said first elongated upright member is in the first position thereof, and a second position wherein said first cam member has the flat top thereof in abutment with the bottom of said first elongated cantelever member and the flat bottom thereof is in contact with the flat top of the first elongated platform member when the first elongated upright member is in the second position thereof; and a second cam member having a flat top edge and a flat bottom edge, said second cam member being pivotally attached to portion of said second elongated upright member at said second horizontal axis, said second cam member being movable between a first position wherein a rear top corner of said second cam member is in contact with the bottom of said second elongated cantelever member and the front bottom of said second cam member is in contact with the top of said second elongated platform member when said second elongated upright member is in the first position thereof, and a second position wherein said second cam member has the flat top thereof in abutment with the bottom of second elongated cantelever member and the flat bottom thereof is in contact with the flat top of the second elongated platform member when the second elongated upright member is in the second position thereof, whereby the seat means and back support are adjustable between a reclined first position and a more upright second position.

* * * * *